US006411723B1

(12) United States Patent
Lock et al.

(10) Patent No.: US 6,411,723 B1
(45) Date of Patent: Jun. 25, 2002

(54) LOUDSPEAKERS

(75) Inventors: Christopher Colin Lock; John Frederick Corey; Graeme Oliver Jones; Kelly Charles Waterman, all of Auckland (NZ)

(73) Assignee: Slab Technology Limited, Auckland City (NZ)

( * ) Notice: Subject to any disclaimer, the term of this patent is extended or adjusted under 35 U.S.C. 154(b) by 0 days.

(21) Appl. No.: 09/337,519

(22) Filed: Jun. 22, 1999

(30) Foreign Application Priority Data

| | | |
|---|---|---|
| Jun. 22, 1998 | (NZ) | 330777 |
| Oct. 13, 1998 | (NZ) | 332328 |
| Jan. 21, 1999 | (NZ) | 333833 |

(51) Int. Cl.[7] ..... H04R 25/00

(52) U.S. Cl. ..... 381/431; 381/425; 381/423; 381/426; 181/173

(58) Field of Search ..... 181/157, 161, 181/163, 173, 199; 381/177, 184, 185, 186, 398, 401–405, 423, 424, 431, FOR 162, FOR 163, 426

(56) References Cited

U.S. PATENT DOCUMENTS

| | | | |
|---|---|---|---|
| 1,273,549 | A | 7/1918 | Chudzikowski |
| 1,500,331 | A | 7/1924 | Marriott |
| 1,768,473 | A | 6/1930 | Gaty |

(List continued on next page.)

FOREIGN PATENT DOCUMENTS

| | | | |
|---|---|---|---|
| EP | 0 054 945 | A1 | 6/1982 |
| GB | 2 010 637 | A | 6/1979 |
| GB | 2050758 | A | 1/1981 |
| GB | 2246684 | A | 2/1992 |
| JP | A-58-200694 | | 11/1983 |
| JP | 59139799 | A | 8/1984 |
| JP | 60192497 | A | 9/1985 |
| JP | 61113399 | A | 5/1986 |
| JP | 62207100 | A | 9/1987 |
| JP | 62269500 | A | 11/1987 |
| JP | 63155997 | A | 6/1988 |
| JP | 63254896 | A | 10/1988 |
| JP | 01027399 | A | 1/1989 |
| JP | 04115698 | A | 4/1992 |
| JP | 04150700 | A | 5/1992 |
| JP | 10243491 | A | 9/1998 |

(List continued on next page.)

OTHER PUBLICATIONS

Harry F. Olson, "Acoustical Engineering," published by Professional Audio Journals, Inc. Philadelphia, PA, USA, 1991 Edition, pp.192–193.

"A Technical White Paper—A Brief Overview," published by New Transducers Ltd., 1996.

Martin Colloms, "High Performance Loudspeakers," published by John Wiley & Sons, 5th Edition, 1997, 194.

Sammi Enterprise Co., Ltd. Catalog, YPE Speaker System, <SS–21OR>, Panel Speaker <SSP–75>, 1978.

Ultra Electric Limited, 061–663 Harrow Road, NW. 10, "UNDY" Brochure, Amateur Wireless, Nov. 1930.

*Primary Examiner*—Stella Woo
*Assistant Examiner*—Suhan Ni
(74) *Attorney, Agent, or Firm*—Young & Thompson

(57) ABSTRACT

A flat panel rectangular or elliptical loudspeaker has one or more anisotropic diaphragms 14, 15, made of double skinned fluted polypropylene copolymer (core flute) or corrugated cardboards having a longitudinal bending strength greater than the transverse bending strength. The diaphragm is vibrated by a driver unit 16 which comprises a magnet 17 and voice coil 18. In this version the magnet 17 is mounted on the rear diaphragm 15 and the voice coil 18 is mounted on the front diaphragm 14. The two diaphragms 14, 15 are mounted at their edges to a frame 11 with the driver unit 16 mounted in the space enclosed by the frame and the diaphragms.

28 Claims, 7 Drawing Sheets

FIG. 8

U.S. PATENT DOCUMENTS

| | | | | | |
|---|---|---|---|---|---|
| 1,778,084 | A | | 10/1930 | Nevin | |
| 2,063,945 | A | | 12/1936 | Pierce | |
| 2,716,462 | A | | 8/1955 | Brennan | |
| 2,815,823 | A | | 12/1957 | Olson et al. | |
| 2,863,520 | A | | 12/1958 | Manley et al. | |
| 2,956,538 | A | | 10/1960 | Rich | |
| 3,111,187 | A | | 11/1963 | Barlow | |
| 3,247,925 | A | | 4/1966 | Warnaka | |
| 3,347,335 | A | | 10/1967 | Watters et al. | |
| 3,578,921 | A | * | 5/1971 | Knauert | 381/186 |
| 3,603,427 | A | | 9/1971 | Sotome | |
| 3,767,005 | A | | 10/1973 | Bertagni | |
| 3,829,623 | A | | 8/1974 | Willis et al. | |
| 3,848,090 | A | | 11/1974 | Walker | |
| 4,013,846 | A | | 3/1977 | Krawczak et al. | |
| 4,190,746 | A | | 2/1980 | Harwood et al. | |
| 4,198,550 | A | * | 4/1980 | Matsuda et al. | 381/398 |
| 4,225,757 | A | | 9/1980 | Babb | |
| 4,252,211 | A | | 2/1981 | Matsuda et al. | |
| 4,272,653 | A | | 6/1981 | Osato et al. | |
| 4,291,205 | A | | 9/1981 | Kamon et al. | |
| 4,300,655 | A | | 11/1981 | Sakamoto et al. | |
| 4,322,583 | A | | 3/1982 | Maeda | |
| 4,323,737 | A | | 4/1982 | Shimada et al. | |
| 4,352,961 | A | | 10/1982 | Kumada et al. | |
| 4,379,952 | A | * | 4/1983 | Kaizer et al. | 381/404 |
| 4,385,210 | A | | 5/1983 | Marquiss | |
| 4,426,556 | A | | 1/1984 | Saiki et al. | |
| 4,514,599 | A | * | 4/1985 | Yanagishima et al. | 381/431 |
| 4,517,416 | A | * | 5/1985 | Goossens | 381/431 |
| 4,550,228 | A | * | 10/1985 | Walker et al. | 381/186 |
| 4,675,907 | A | * | 6/1987 | Itagaki et al. | 381/186 |
| 4,783,824 | A | | 11/1988 | Kobayashi | |
| 4,899,390 | A | | 2/1990 | Takewa et al. | |
| 4,997,058 | A | | 3/1991 | Bertagni | |
| 5,025,474 | A | | 6/1991 | Tanaka et al. | |
| 5,073,946 | A | * | 12/1991 | Satoh et al. | 381/186 |
| 5,102,729 | A | | 4/1992 | Yamaguchi et al. | |
| 5,231,672 | A | * | 7/1993 | Tsao | 381/431 |
| 5,594,804 | A | * | 1/1997 | Kim | 381/186 |
| D415,764 | S | | 10/1999 | Azima et al. | |
| D416,907 | S | | 11/1999 | Azima et al. | |
| D420,005 | S | | 2/2000 | Azima et al. | |
| 6,031,926 | A | | 2/2000 | Azima et al. | |
| 6,144,746 | A | | 11/2000 | Azima et al. | |
| 6,169,809 | B1 | | 1/2001 | Azima et al. | |
| 6,181,799 | B1 | | 1/2001 | Azima et al. | |
| 6,188,775 | B1 | | 2/2001 | Azima et al. | |
| 6,192,136 | B1 | | 2/2001 | Azima et al. | |
| 6,198,831 | B1 | | 3/2001 | Azima et al. | |
| 6,201,878 | B1 | | 3/2001 | Azima et al. | |
| 6,215,881 | B1 | | 4/2001 | Azima et al. | |

FOREIGN PATENT DOCUMENTS

| | | | |
|---|---|---|---|
| JP | 11205881 | A | 7/1999 |
| JP | 11234771 | A | 8/1999 |
| JP | 11234785 | A | 8/1999 |
| JP | 11331966 | A | 11/1999 |
| JP | 2000295692 | A | 10/2000 |
| WO | 92/03024 | | 2/1992 |
| WO | 93/21743 | | 10/1993 |
| WO | 95/06397 | | 3/1995 |
| WO | 97/09840 | | 3/1997 |
| WO | 97/09842 | | 3/1997 |
| WO | WO9709842 | | 3/1997 |
| WO | 97/09844 | | 3/1997 |
| WO | 97/09845 | | 3/1997 |
| WO | 97/09846 | | 3/1997 |
| WO | 97/09847 | | 3/1997 |
| WO | 97/09848 | | 3/1997 |
| WO | 97/09849 | | 3/1997 |
| WO | 97/09852 | | 3/1997 |
| WO | 97/09853 | | 3/1997 |
| WO | 97/09856 | | 3/1997 |
| WO | 97/09857 | | 3/1997 |
| WO | 97/09858 | | 3/1997 |
| WO | 97/09859 | | 3/1997 |
| WO | 97/09861 | | 3/1997 |
| WO | 97/09862 | | 3/1997 |
| WO | 98/16409 | | 4/1998 |
| WO | WO9816409 | | 4/1998 |
| WO | 98/28942 | | 7/1998 |
| WO | 98/31188 | | 7/1998 |
| WO | 98/34320 | | 8/1998 |
| WO | WO9839947 | | 9/1998 |
| WO | 98/39947 | | 9/1998 |
| WO | 98/42536 | | 10/1998 |
| WO | 98/52381 | | 11/1998 |
| WO | WO9852383 | | 11/1998 |
| WO | 99/08479 | | 2/1999 |
| WO | 99/12387 | | 3/1999 |
| WO | 99/37121 | A1 | 7/1999 |
| WO | 99/41939 | | 8/1999 |
| WO | 99/52322 | | 10/1999 |
| WO | 99/52324 | | 10/1999 |
| WO | 99/56497 | | 11/1999 |
| WO | 99/62294 | | 12/1999 |
| WO | 00/02417 | | 1/2000 |
| WO | 00/05920 | | 2/2000 |
| WO | 00/07409 | | 2/2000 |
| WO | 00/15000 | | 3/2000 |
| WO | 00/22877 | | 4/2000 |
| WO | 00/33613 | | 6/2000 |
| WO | 00/35242 | | 6/2000 |
| WO | 00/45616 | | 8/2000 |
| WO | 00/46786 | | 8/2000 |
| WO | 00/48425 | | 8/2000 |
| WO | 00/48427 | | 8/2000 |
| WO | 00/54549 | | 9/2000 |
| WO | 00/54552 | | 9/2000 |
| WO | 00/67524 | | 11/2000 |
| WO | 00/67525 | | 11/2000 |
| WO | 00/70909 | | 11/2000 |
| WO | 00/72627 | A2 | 11/2000 |
| WO | 00/72627 | A3 | 11/2000 |
| WO | 01/08447 | A2 | 2/2001 |
| WO | 01/18132 | A2 | 3/2001 |

* cited by examiner

LOUDSPEAKERS

BACKGROUND OF THE INVENTION

1. Field of the Invention

This invention relates to loudspeakers, and is applicable particularly, but not exclusively to loudspeakers intended to be hung adjacent a wall, in the manner of a picture.

2. Description of the Related Art

Flat loudspeakers have been known for many years, for example free-standing electrostatic loudspeakers. However, such loudspeakers have had to be large and therefore obtrusive in order to produce a satisfactory sound level. They have been expensive and have had a less than desirable sound frequency response and sound distribution pattern.

Various other types of flat, wall-mountable loudspeakers have been devised, but again they have suffered variously from inferior frequency response or stereophonic performance.

BRIEF SUMMARY OF THE INVENTION

According to one aspect of the present invention there is provided a loudspeaker including a substantially planar first diaphragm which can be vibrated so as to radiate sound from at least the front face thereof, and a driver unit operable by a varying electric current in order to generate a varying force on the first diaphragm, the force varying in a manner related to the varying electric current, characterised by the driver unit being connected to the first diaphragm at one or more selected positions or mounted to structure which is in turn connected to the diaphragm at one or more selected positions.

Preferably the material of the diaphragm is anisotropic (with different characteristics in each of its major axis).

More preferably the material (without apertures) has a bending strength in one direction of the plane of the material which is significantly greater than the bending strength along a line in the plane of the material at right angles to the first direction.

In its most preferred form it has a longitudinal bending strength which is about twice its transverse bending strength, which is particularly suitable to panels which are rectangular or elliptical.

Preferably the loudspeaker includes a substantially rigid peripheral frame having a front face and a rear face, said first diaphragm extending right across the front face and a rear diaphragm extending right across the rear face whereby the interior space of the loudspeaker is substantially enclosed.

Conveniently the driver unit is located within said space remote from the frame.

Advantageously the driver unit is located outside said space remote from the frame.

Preferably the driver unit is connected to both of said diaphragms whereby the driver unit will apply varying force, corresponding to the varying electric current, to said diaphragms and cause at least one of said diaphragms to flex and emit an acoustic signal from the face of the diaphragm exterior of the loudspeaker.

Conveniently both said diaphragms are flexible and the driver operates the diaphragms in bi-polar mode, that is they move outwards together or inwards together.

Preferably one of said diaphragms is flexible and the other is rigid.

Conveniently the driver unit is mounted to the diaphragm at said one or more selected positions, said positions being remote from the peripheral edge of the diaphragm.

Advantageously the driver unit is mounted on a body which is mounted on pillars to the diaphragm at said positions.

Preferably said positions are selected so that flexure of the diaphragm in one or more of its natural modes of vibration is not impeded.

Said first diaphragm and/or said rear diaphragm may be of double skinned polypropylene copolymer, and may be approximately 3 mm thick.

Conveniently the or each diaphragm is approximately 500 grams or less per square metre, and may have a tensile strength of around 28 MPa or more and may have a Shore hardness of 67 or more.

Preferably the surface of the or each diaphragm is treated with a corona discharge to assist adhesion of paint or paper thereto, or of the diaphragm to the frame.

Conveniently the or each diaphragm has longitudinal ribs forming part of its structure perhaps on one face although in its most preferred form they are internal (ie covered by smooth front ant rear faces). Preferably these ribs are provided by a core of corrugated material or the like and may be square or rectangular and each edge is around 400 mm long.

Advantageously the driver unit includes two co-axial voice coils, each fastened to a different one of said diaphragms, the voice coils co-acting with a magnet suspended centrally between said voice coils.

Conveniently the or each diaphragm is slightly fluted or corrugated or slightly curved, so as to provide a modified acoustic performance of the loudspeaker.

The interior of the loudspeaker may constitutes a sealed box. Alternatively one or more ports or vents may be provided through the frame or through one or both or said diaphragms.

Preferably the first diaphragm is made of a sheet of extruded plastics material having integral front and skins joined by closely spaced parallel walls normal to said skins.

In another aspect the invention provides a loudspeaker including a substantially planar diaphragm which can be vibrated so as to radiate sound from at least the front face thereof, and a driver unit operable by a varying electric current in order to generate a varying force on the diaphragm, the force varying in a manner related to the varying electric current, in which the diaphragm is made of front and rear parallel sheets of material, said sheets being spaced apart by a plurality of walls extending between said sheets and said walls being parallel to each other and extending substantially normal to said sheets, or being of generally rhomboidal or sinusoidal corrugated form.

Preferably the diaphragm is of double skinned polypropylene co-polymer and the walls are substantially normal to said parallel sheets.

Alternatively, the diaphragm is of paper or cardboard, said walls being of substantially corrugated form and being fastened by adhesive to the inner opposing faces of the parallel sheets.

Conveniently the driver unit includes a magnet, one pole of which is in magnetic continuity with a yoke and the other pole of which is positioned from the yoke by an air gap through which gap a voice coil is operable, the voice coil being attached to drive the diaphragm.

Preferable the magnet is a cylindrical permanent magnet and the yoke is co-axial therewith, said air gap being annular. More preferably the magnet is a high strength permanent magnet such as a neodymium magnet.

Advantageously, the yoke is made from low oxygen pure iron annealed very slowly in hydrogen.

Conveniently the voice coil has more windings per unit length thereof away from that axial part of the voice coil which is in said air gap when no electric current is passed through the windings.

For this purpose, the voice coil winding is a single layer, with the windings spaced apart in the region of said axial part. Preferably the voice coil is made of pure copper (although aluminium wire could also be used).

Alternatively or in addition, more than said single layer is wound at regions of the voice coil further from said axial part.

According to another aspect of the present invention there is provided a loudspeaker including a diaphragm which can be vibrated so as to radiate sound from at least the front face thereof, and a driver unit operable by a varying electric current in order to generate a varying force on the diaphragm, the force varying in a manner related to the varying electric current, in which a voice coil of the driver unit is connected to said diaphragm, by means of a panel of material, said panel being of a material and having dimensions such that at a low range of audio frequencies, the voice coil and at least that part of the diaphragm adjacent the panel move substantially at the same amplitude and phase, while at a higher range of audio frequencies at least said part of the diaphragm and a part of the panel adjacent thereto move at a lower amplitude and/or at a different phase from the voice coil, whereby at said higher range a substantial part of the sound emitted by the loudspeaker is radiated from a face of the panel adjacent the voice coil.

Preferably the diaphragm is a planar diaphragm.

Conveniently a sheet of damping material is connected from a stationary part of the loudspeaker to said part of the diaphragm adjacent the panel or to the panel.

The damping material may be cloth or cloth based.

Preferably the damping material is porous or perforated so as to allow the passage of air therethrough.

BRIEF DESCRIPTION OF THE DRAWINGS

One embodiment of the invention is described, by way of example only, with reference to the accompanying drawings in which.

DESCRIPTION OF THE PREFERRED EMBODIMENTS

EXAMPLE 1

Figure 1:
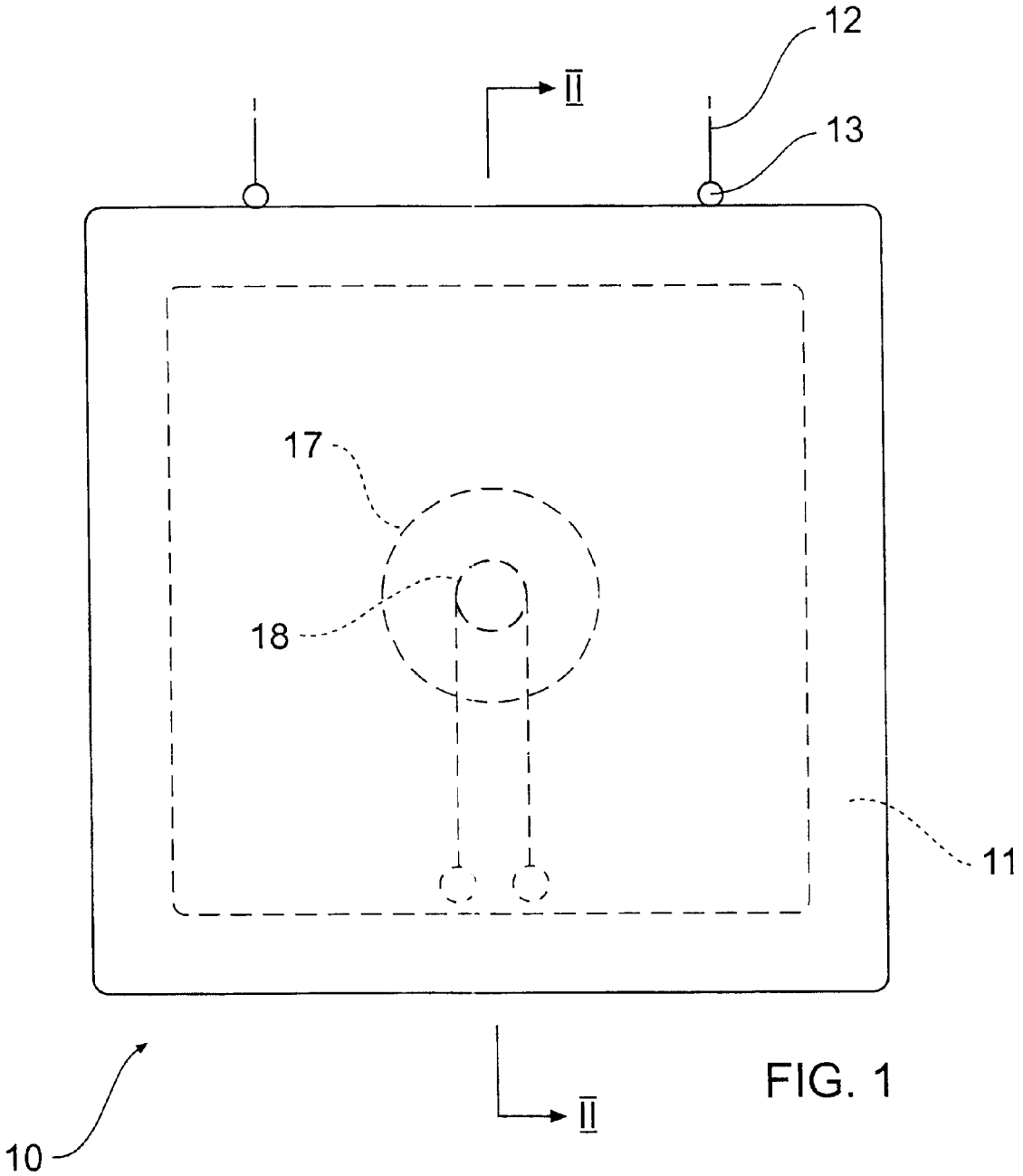
FIG. 1 is a front view of a loudspeaker, according to the invention.

In the drawings, a flat loudspeaker 10 includes a square peripheral frame 11 conveniently made of medium density fibreboard. Each external edge of the frame 11 is conveniently 400 mm long. The frame is suspended by wires or cords 12 attached to loops or other fasteners 13 at the top of the frame 11.

Figure 2:
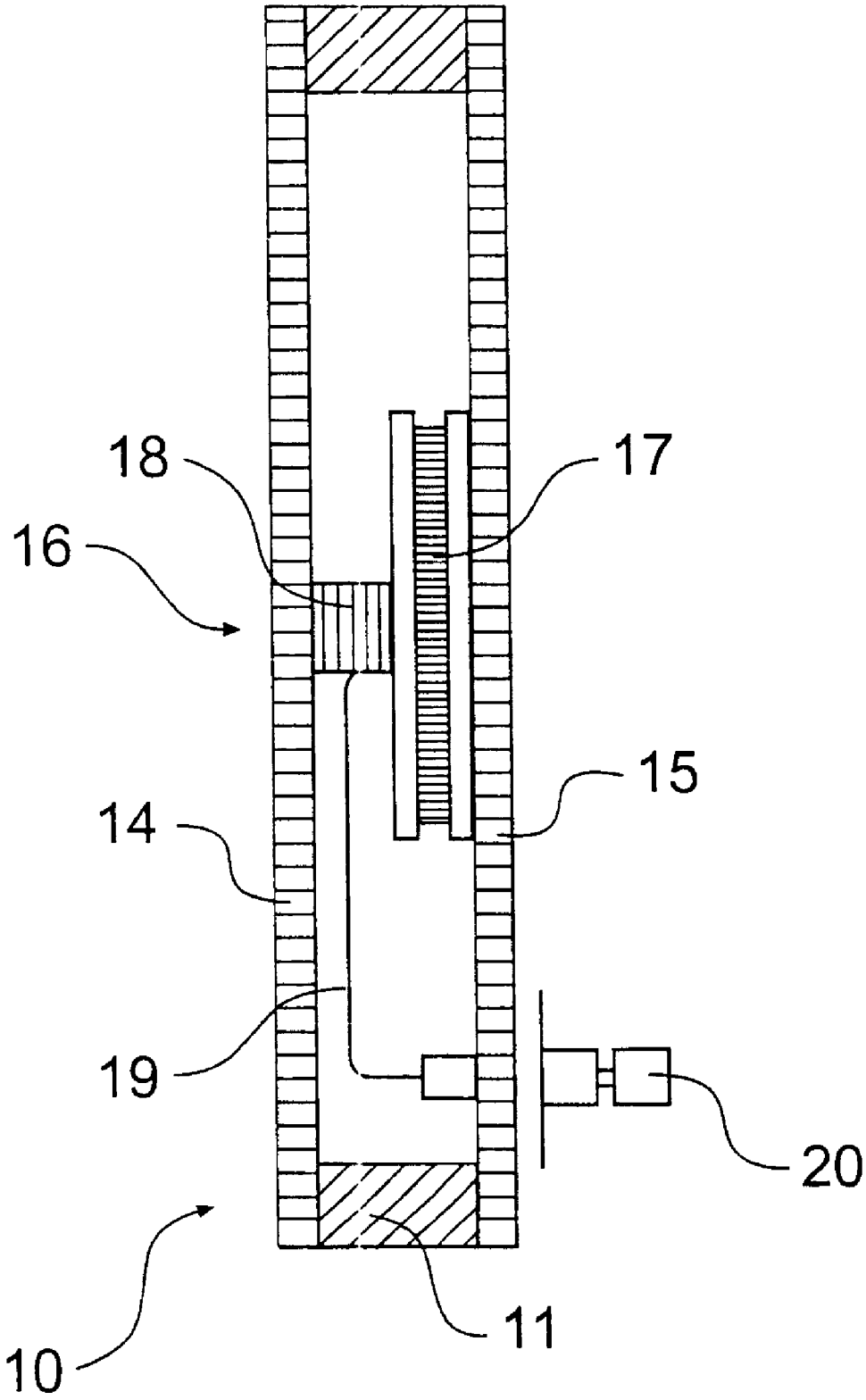
FIG. 2 is a cross-section in a vertical plane along the line II—II in FIG. 1.

As seen, particularly in FIG. 2, the front of the loudspeaker 10 is covered by a front diaphragm 14 which is attached and sealed around the edges thereof by a suitable adhesive to the front face of the frame 11. Similarly the rear of the loudspeaker 10 is covered by a rear diaphragm 15 attached and sealed to the rear face of the frame 11 by an adhesive. Thus, the interior of the loudspeaker 10 constitutes a sealed box. Typically, the thickness between the front and the rear faces of the diaphragm 14 are 30 millimetres for a 400 millimetres square loudspeaker.

It has been found that a suitable material for the front and rear diaphragms 14, 15 is a double skinned sheet made from a polypropylene copolymer approximately 3 millimetres thick and approximately 500 grams per square metre or less. Preferably the sheet is fluted, has a tensile strength of around 28 MPa or more and shore hardness of 67 or more. The material preferably has a-corona discharge treated surface to assist adhesion of paint, or wallpaper to the exterior surfaces of the diaphragms 14, 15 and to assist adhesion of the interior surfaces of the diaphragms 14, 15 to the frame 11. The sheet is preferably an extrusion. One such a material is known as "core flute" material from the shape of the internal longitudinal "flutes" or corrugations see FIG. 4 (discussed below). Another practical material is lightweight corrugated card.

A driver unit 16 is positioned adjacent the centre of the diaphragms 14, 15. The driver unit is similar to those used in conventional cone-type loudspeakers and includes a magnet 17, which can be a permanent magnet or an electromagnet, and a coacting voice coil 18. The voice coil 18 carries the usual winding connected by leads 19 to terminals 20 on the rear of the loudspeaker 10. The magnet 17 is fastened, for example, by an adhesive to the interior surface of the rear diaphragm 15 and the voice coil 18 is fastened to the interior surface of the front diaphragm 14. The dimensions of the driver unit 16 and the spacing of the front and rear diaphragms 15, are arranged so that the voice coil 18 is in the correct operative position relative to the magnet 17, and properly centered therein.

Depending on the acoustic properties required from the loudspeaker 10, the interior thereof may be at least partly filled with fibrous or other sound absorbent material or may be left empty. Similarly, one or more ports or vents may be provided through the frame 11 or the diaphragms 14, 15.

Although the loudspeaker 10 has been shown as being square, it could be circular, elliptical, rectangular, polygonal or and other suitable shape. If required more than one driver unit 16 may be provided as suitable locations inside the loudspeaker 10.

In another embodiment, the front diaphragm 14 or the rear diaphragm 15 may be of substantially rigid material. Furthermore, the magnet 17 may be fitted to the front diaphragm 14 and the voice coil 18 to the rear diaphragm 15.

For some purposes it may be preferable to provide two coaxial voice coils 18 each fastened to a different one of the diaphragms 14, 15 and coacting with a centrally suspended magnet 17. Conversely, two magnets 17 can be provided on the diaphragms 14, 15 coacting with a centrally suspended voice coil 18.

Either surface of each diaphragm 14, 15 may be slightly fluted and instead of either diaphragm being flat, it could be corrugated or otherwise curved so as to provide a modified acoustic performance of the loudspeaker 10.

EXAMPLE 2

Figure 3:
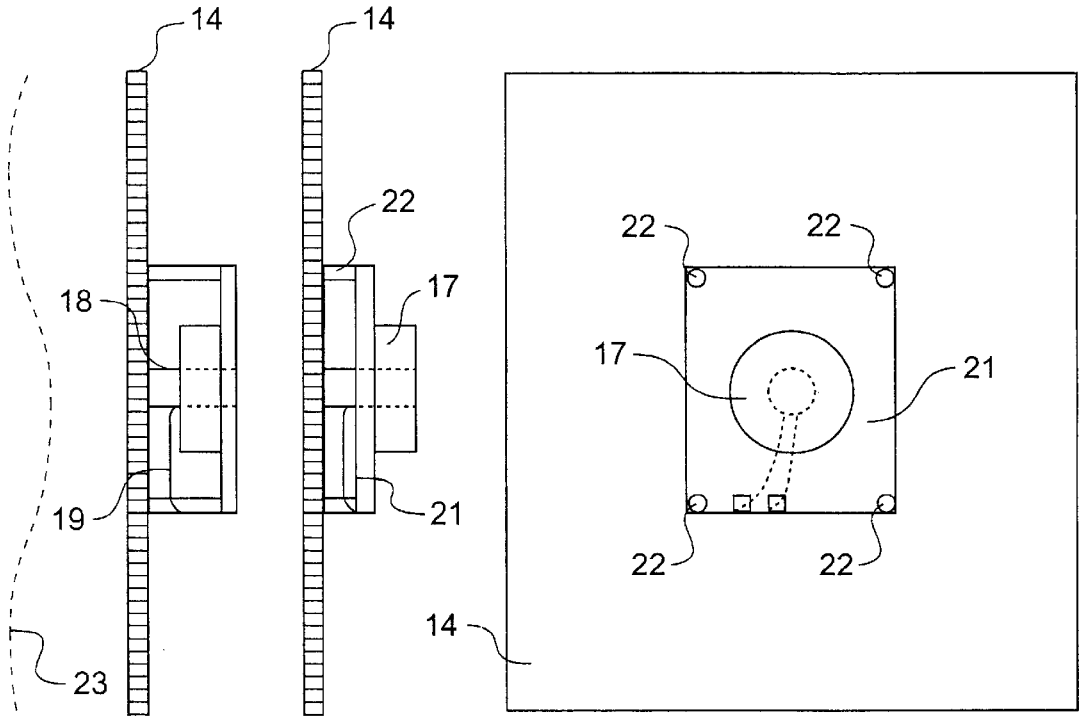
FIG. 3 shows a rear and side views of an alternative embodiment.

In FIG. 3 the frame 11 and rear diaphragm 15 are omitted. The magnet 17 is mounted on a plate 21 which is mounted on the diaphragm 14 on pillars 22. The pillars 22 are at carefully selected positions on the diaphragm 14, so that they do not impede flexure of the diaphragm in one of its natural modes, for example as shown by the line 23. The magnet 17 may be mounted between the plate 21 and diaphragm 14, or on the rear of the plate 21, as shown.

The loudspeaker shown in FIG. 3 may be suspended from the top edge of the diaphragm 14 or from the plate 21 or pillars 22.

Figure 4:
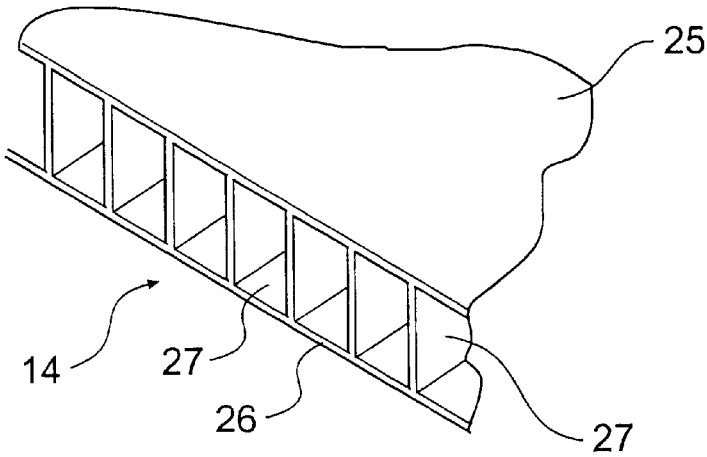
FIG. 4 is a partial perspective view of a component of the loudspeaker.

FIG. 4 shows a preferred construction for the front diaphragm 14. It comprises an integral extrusion of polyethylene around 3–5 mm thick and having front and rear skins 25, 26 joined by continuous longitudinal walls 27 with air spaces therebetween. By this construction, the material of the diaphragm 14 is anisotropic and has a longitudinal bending strength which may typically be around twice the transverse bending strength. Thus, this material is particularly useful in the construction of rectangular loudspeakers, for example those having sides of 200 mm×100 mm long. Larger or smaller panels can be made using this type of material.

EXAMPLE 3

Figure 5:
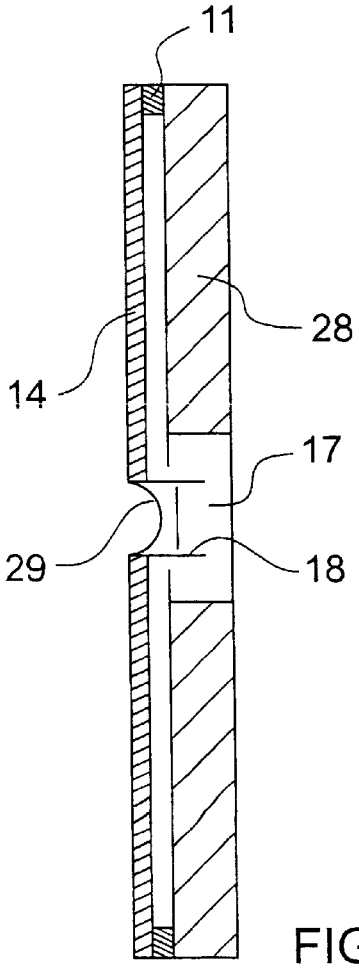
FIG. 5 is a cross-section of a further embodiment.

FIG. 5 shows a loudspeaker having a rigid rear panel 28 of custom wood around 12 mm thick, with the magnet 17 fastened in the centre thereof. The frame 11 holds the front diaphragm 14 at a distance of around 3–5mm from the front face of the panel 28. The voice coil 18 is held in the gap in the magnet 17 by being fastened in a central hole in the diaphragm 14. The hole is closed by a concave part-spherical cap 29, fastened in the voice coil 18.

Figure 6:
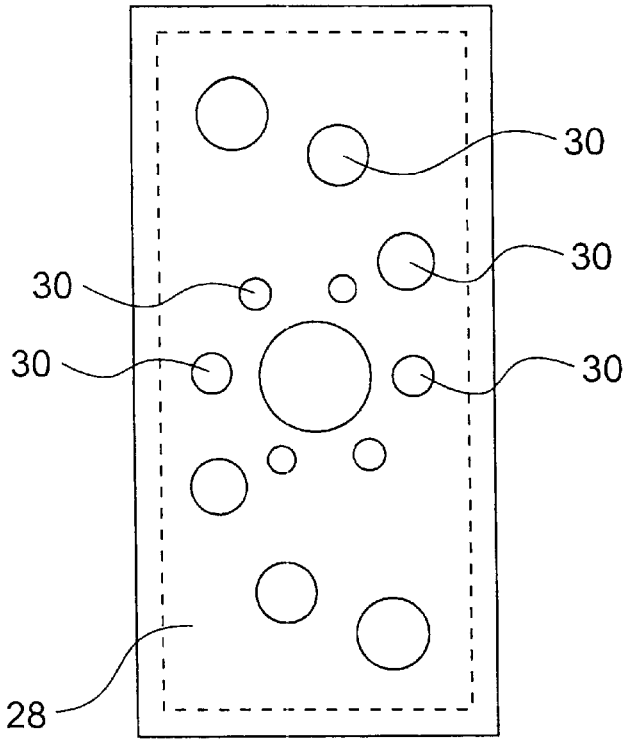
FIG. 6 is a first rear view of the embodiment shown in FIG. 5.

In order to allow desired motion of the diaphragm 14, the panel 28 (shown in FIG. 6) has an array of holes or ports 30 therethrough. The sizes and locations of the ports 30 are carefully chosen to achieve a smooth frequency response from the loudspeaker 10.

Figure 7:
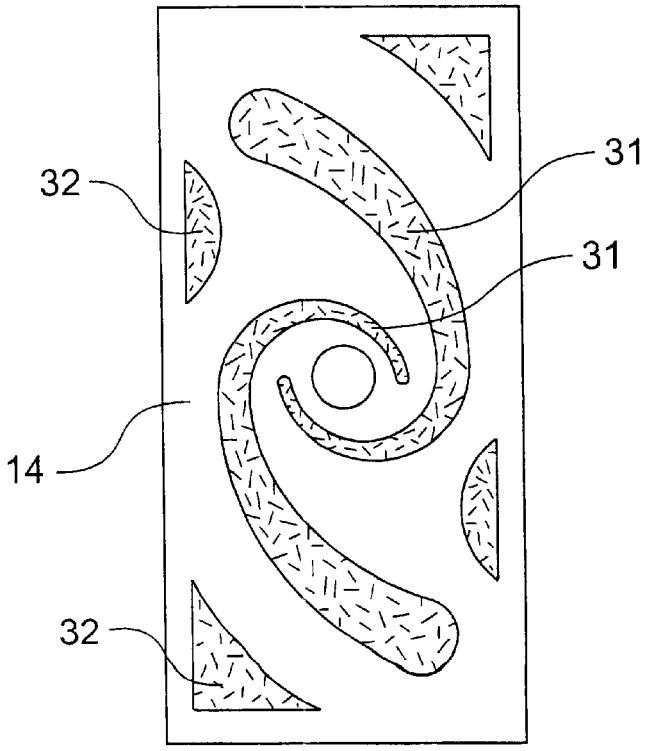
FIG. 7 is a second modified rear view of the component shown in FIG. 4.

Alternative, or additional modification of the frequency response curve is achieved by adhesion of mass adding material 31, as shown in FIG. 7. Suitable material is bituminous sheet loaded with metallic or mineral particles.

Further adjustment of frequency performance can be obtained by attaching areas of sound absorbent material 32 to the diaphragm 14 or to the front face of the panel 28, as shown in FIG. 7. Supply of electrical signal to the voice coil 18 is conveniently through copper foil strips stuck to one face of the diaphragm 14.

EXAMPLE 4

Figure 8:
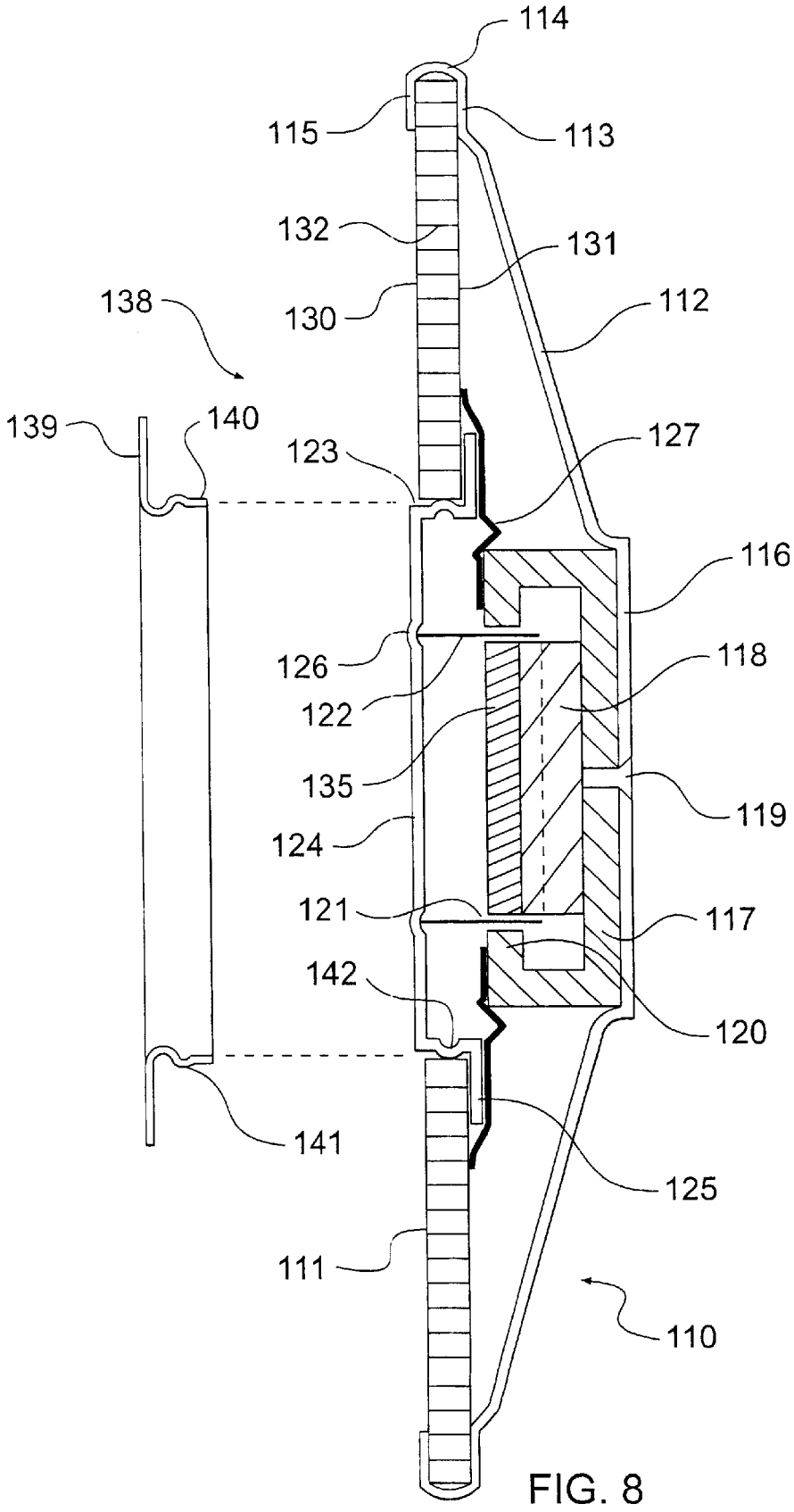
FIG. 8 is a transverse section through another embodiment.
Figure 9:
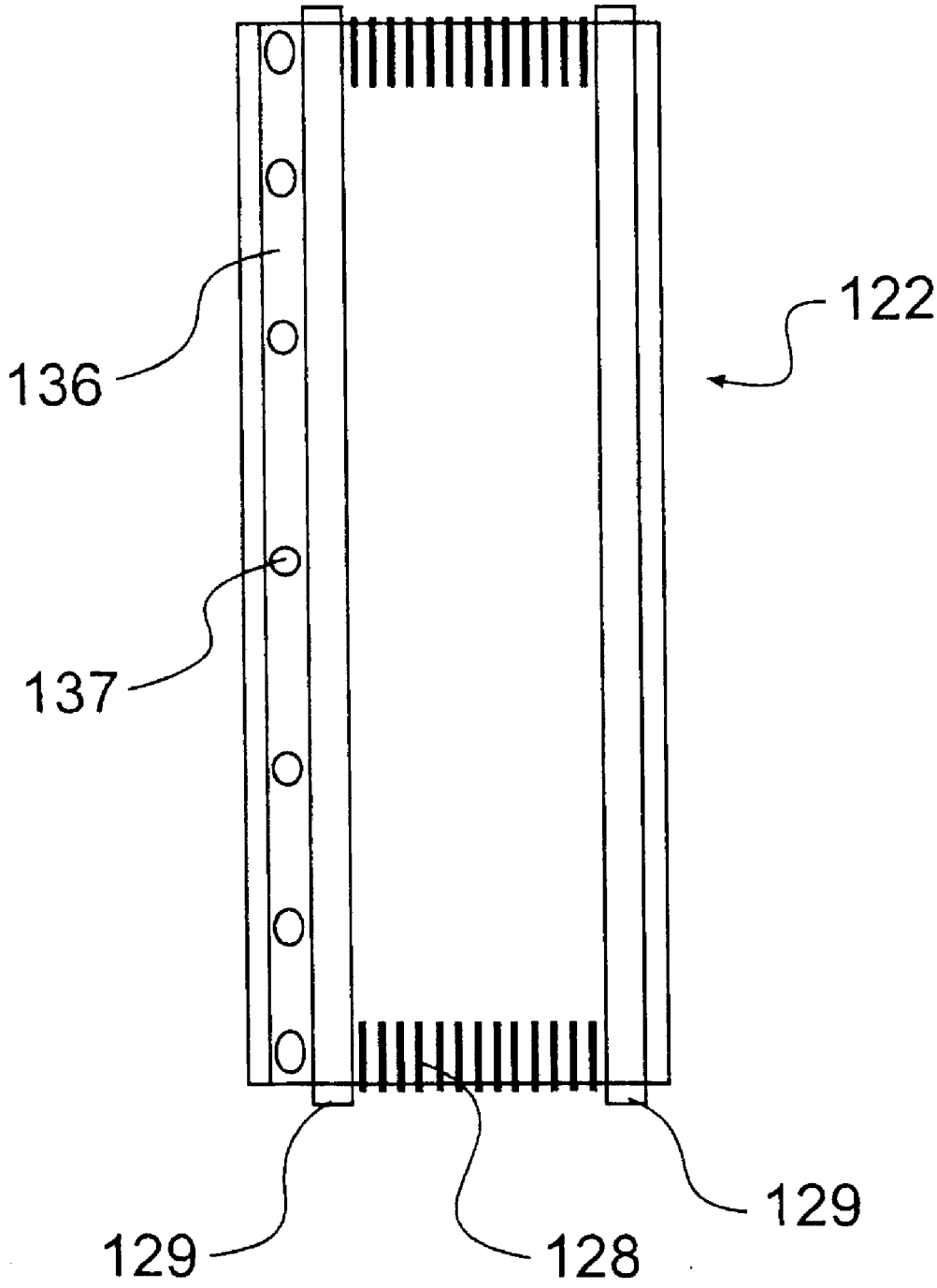
FIG. 9 is a side view of a voice coil shown in section in FIG. 8.

In FIGS. 8 and 9, a loudspeaker 110 includes a diaphragm 111, to be described later. The outer edge of the diaphragm 111 is gripped by the outer edge of a substantially rigid metal or plastics dish 112. For this purpose, the dish is provided with a flat 113 on which the diaphragm 111 rests, the diaphragm 111 being located by a substantially upright wall 114 and being gripped by an edge portion 115 of the dish 112, which is folded or rolled over the outer edge of the diaphragm 111. The centre portion of the dish 112 is formed as a cup 116 in which a cylindrical yoke 117 is located. Thus, the dish 112 serves to centre the yoke 117 relative to the diaphragm 111, where it is retained by a screw 119.

Since the yoke 117 forms part of a magnetic circuit, it is preferably made of low oxygen pure iron which has been annealed slowly in hydrogen. A permanent magnet 118 is held coaxial with the yoke 117 by adhesive. One pole of the magnet 118 is in magnetic contact with the upper interior surface of the yoke 117 and the other pole is adjacent a disc 135, of the same material and thickness as a flange 120 of the yoke 117. Thus, an annular magnetic gap 121 is formed between the flange 120 and the upper part of the magnet 118. A cylindrical voice coil 122 extends through the gap 121. The yoke material serves to keep the lines of magnetic flux within the yoke 117, which minimises undesirable external magnetic fields and also concentrates the flux across the gap 121.

In an aperture 123 through the diaphragm 111, there is positioned and fastened a panel 124 of thin material, such as aluminium typically 0.25 mm thick. The panel 124 has an out-turned flange 125 fastened to the diaphragm 111. The voice coil 122 is fastened by adhesive into a groove 126 formed in the panel 124, so that the voice coil 122 is held concentrically within the gap 121. Movement of the central area of the diaphragm 111 is damped by a damping ring 127 which may be of cloth or cloth-like material, is preferably corrugated and is fastened by adhesive to the upper surface of the flange 120 and to the flange 125 and/or the diaphragm 111.

The dish 112 may form an airtight enclosure with the diaphragm 111 and panel 124, but if preferred, holes or perforations my be provided through the dish 112. The internal space within the loudspeaker 110 may include fibrous or foam plastics sound absorbent material. The thickness and material of the panel 124 are chosen so that, for example, at frequencies up to 1000 Hz the panel 124 acts as a substantially rigid member and moves the adjacent area of the diaphragm 111 therewith when alternating current is passed through windings 128 on the voice coil 122. At frequencies above 5000 Hz flexure of the panel 124 is such that the periphery thereof and adjacent areas of the diaphragm 111 move much less than the voice coil 122 and the central area of the panel 124. Thus, at these high frequencies sound is radiated almost entirely from the centre area of the panel 124. Between those frequencies sound radiation occurs from only a small area of the diaphragm 111 and from parts of the panel 124.

In order to modify the frequency response of the loud speaker 110 at large excursions of the voice coil 122, the windings 128 may have more turns per unit length towards the ends of the winding 128 than in the centre thereof. This may be achieved by spacing the windings in the centre or by close-winding the turns throughout the length thereof and adding one or more layers 129 adjacent the ends thereof. The coils are wound on a former 136 provided with perforations 137.

It has been found that a suitable material for the diaphragms 111 is a double skinned sheet made from a polypropylene co-polymer approximately 3 millimetres thick and approximately 500 grams per square metre or less. Preferably the diaphragm 111 has a tensile strength of around 128 MPa or more and shore hardness of 67 or more. The material preferably has a corona discharge treated surface to assist adhesion of paint, wallpaper etc to the diaphragms 111. The diaphragm 111 is preferably a laminate having a core of foam, or has ribs, tubes, corrugated sheet or the like. If it has a foam core it preferable that the foam is not uniform (or the cover sheets are shaped or reinforced). For example the foam core could be shaped or reinforced in such a way that the bending stiffness is greater in one direction than another.

The diaphragm 111 may comprise an integral extrusion of polyethylene around 3 to 5 mm thick and having front and rear skins 130, 131 joined by continuous longitudinal walls 132 with air spaces therebetween. By this construction, the material of the diaphragm 111 is anisotropic and has a longitudinal bending strength which may typically be around twice the transverse bending strength. Thus, this material is particularly useful in the construction of rectangular loudspeakers, for example those having sides of 200 mm×100 mm long.

FIG. 8 shows the use of a retaining ring 138, of thin aluminium or the like. The ring 138 has a flange 139, which can press down on the external skin 130 of the diaphragm 111. An integral cylindrical portion 140 can be pushed down between the edge of the aperture 123 and the outside surface of the cylindrical part of the panel 124, which has a rib 142 which clicks into a groove 141 in the portion 140 of the ring 138. The rib 142 and groove 141 may be reversed, if preferred.

The invention has the following advantages over the prior art.

Ease of manufacture.

Good acoustics achievable at a low cost of construction.

Lightweight diaphragm material particularly suite to rectangular or elliptical panels. Scalability.

Loudspeakers or diaphragms can be made in many different sizes or shapes, or readily disguised as other objects.

This invention lends itself to flat panel speakers of A5 size or smaller which are particularly suited for the multimedia market, or for inclusion in vehicles fitted into dashboards or into vehicle doors. The can work in any orientation and depending upon design can be provided with or without a surrounding frame.

Although preferred embodiments have been disclosed, the invention includes variations such as those which follow.

One or more drivers may be used depending upon the size of the diaphragm. The loudspeakers may be tuned by porting or by adding weights. In the drawings we have show porting in the back panel (FIGS. 6 and 7) but similar porting may be provided in the material of the diaphragm. The panels may be tuned by the use of a powder such as sugar or the like on the panel when horizontal so that the nodes can be observed on the panel.

The diaphragms can be made of any shape (eg they could have irregular outlines if needed). They need not be flat although this is preferred.

Materials other than core flute or corrugated cardboard can be used. Preferably the material is light weight and stiff but flexible. In the preferred embodiments standard extruded core flute of 3 mm thickness has been used but other thicknesses between 2 mm and 5 mm could be used for most applications. Larger panels may require more drivers and a thicker core flute diaphragm.

The loudspeaker could be disguised as part of a vehicle or part of furniture or a box or a painting or almost any object as size or shape is no longer a restriction. In one example we have included flat panel loudspeakers as part of a vehicle dashboard and in another application we have made a painting operate as a loudspeaker.

Finally various other alterations or modifications may be made to the foregoing without departing from the scope of this invention as set forth in the following claims.

What is claimed is:

1. A loudspeaker comprising:

a substantially planar diaphragm which can be vibrated so as to radiate sound from at least a front face thereof; and a driver unit operable by a varying electric current in order to generate a varying force on the diaphragm, the force varying in a manner related to the varying electric current, the diaphragm comprising an extrusion of a plastics material having parallel skins spaced apart by wall means which defines elongated passageways between the skins generally parallel with the skins and with one-another, wherein the diaphragm has a bending stiffness longitudinally of said passageways greater than its bending stiffness transverse thereto.

2. A loudspeaker as claimed in claim 1, further comprising:

a substantially rigid peripheral frame having a front face and a rear face, said first-mentioned diaphragm extending wholly across the front face; and another diaphragm extending wholly across the rear face, whereby the interior space of the loudspeaker is substantially enclosed.

3. A loudspeaker as claimed in claim 2, wherein the driver unit is connected to both of said diaphragms whereby the driver unit will apply varying force, corresponding to the varying electric current, to said diaphragms and cause at least one of said diaphragms to flex and emit an acoustic signal from the face of the diaphragm exterior loudspeaker.

4. A loudspeaker as claimed in claim 2 wherein the driver unit comprises two co-axial voice coils, each fastened to a different one of said diaphragms, the voice coils co-acting with a magnet suspended centrally between said voice coils.

5. A loudspeaker as claimed in claim 2 wherein the driver unit includes a magnet, one pole of which is magnetic continuity with a yoke and the other pole of which is positioned from the yoke by an air gap through which gap a voice coil is operable, the voice coil being attached to drive the first-mentioned diaphragm, the yoke being made from low oxygen pure iron annealed very slowly in hydrogen.

6. A loudspeaker as claimed in claim 5 wherein a member made of the same material as the yoke is in magnetic continuity with said other pole of the magnet, the air gap being formed between a peripheral portion of said member and an opposing part of the yoke.

7. A loudspeaker as claimed in claim 6 wherein said peripheral portion of the member and said opposing part of the yoke are of substantially the same thickness.

8. A loudspeaker as claimed in claim 5 wherein the voice coil has more windings per unit length thereof away from that axial part of the voice coil which is in said air gap when no electric current is passed through the windings.

9. A loudspeaker as claimed in claim 8 wherein the voice coil winding is a single layer, with the windings spaced apart in the region of said axial part.

10. A loudspeaker as claimed in claim 9 wherein more than said single layer is wound at regions of the voice coil further from said axial part.

11. A loudspeaker as claimed in claim 5, wherein the voice coil is connected to said first-mentioned diaphragm by means of a panel of material and having dimensions such that at a low range of audio frequencies at least said part of the diaphragm and a part of the panel adjacent thereto move at a lower amplitude and/or at a different phase from the voice coil, whereby at said higher range a substantial part of the sound emitted by the loudspeaker is radiated from a face of the panel adjacent the voice coil.

12. A loudspeaker as claimed in claim 11, wherein a sheet of damping material is connected from a stationary part of the loudspeaker to said part of the diaphragm adjacent the panel or to the panel, the damping material being porous or perforated so as to allow the passage of air therethrough.

13. A loudspeaker as claimed in claim 1, wherein the wall means comprises parallel walls.

14. A loudspeaker as claimed in claim 1, wherein the wall means is a fluted structure of a sinusoidal cross section.

15. A loudspeaker as claimed in claim 1, wherein the diaphragm has a bending stiffness longitudinally of said passageways greater than its bending stiffness transverse thereto, and the extrusion of plastics material of diaphragm is extruded in one piece.

16. A loudspeaker as claimed in claim 1, wherein the plastic material is polypropylene.

17. A loudspeaker as claimed in claim 16, wherein the wall means comprises parallel walls.

18. A loudspeaker as claimed in claim 16, wherein the wall means is a fluted structure of a sinusoidal cross section.

19. A loudspeaker as claimed in claim 16, wherein the diaphragm is approximately 500 grams or less per square meter.

20. A loudspeaker as claimed in claim 19, wherein the polypropylene of the diaphragm has a tensile strength of 28 MPa or more.

21. A loudspeaker as claimed in claim 20, wherein the polypropylene material of the diaphragm has a Shore hardness of 67 or more.

22. A loudspeaker as claimed in claim 20, wherein the external surfaces of the diaphragm are treated with a corona discharge to assist adhesion.

23. A loudspeaker, comprising:

a substantially planar diaphragm which can be vibrated so as to radiate sound from at least a front face thereof; and a driver unit operable by a varying electric current in order to generate a varying force on the diaphragm, the force varying in a manner related to the varying electric current, the diaphragm comprising a unitary hollow polypropylene panel which is both light weight and stiff, the panel having parallel skins spaced apart by longitudinal members defining elongated parallel passageways between the skins, the members and the skins together being formed as a single continuous piece free of any intervening material therebetween.

24. A loudspeaker as claimed in claim 23, wherein, the diaphragm is approximately 500 grams or less per square meter.

25. A loudspeaker as claimed in claim 24, wherein, the polypropylene of the diaphragm has a tensile strength of 28 MPa or more.

26. A loudspeaker as claimed in claim 25, wherein, the polypropylene material of the diaphragm has a Shore hardness of 67 or more.

27. A loudspeaker as claimed in claim 26, wherein, external surfaces of the diaphragm are treated with a corona discharge to assist adhesion.

28. A loudspeaker, comprising:

a substantially planar diaphragm which can be vibrated so as to radiate sound from at least a front face thereof; and a driver unit operable by a varying electric current in order to generate a varying force on the diaphragm, the force varying in a manner related to the varying electric current, the diaphragm comprising an extruded unitary hollow polypropylene panel which is both light weight and stiff, the panel having parallel skins spaced apart by longitudinal ribs defining elongated parallel passageways between the skins, the ribs and skins together being extruded in a single piece.

* * * * *